United States Patent [19]

Justheim

[11] 4,384,614

[45] May 24, 1983

[54] METHOD OF RETORTING OIL SHALE BY VELOCITY FLOW OF SUPER-HEATED AIR

[75] Inventor: Clarence I. Justheim, Salt Lake City, Utah

[73] Assignee: Justheim Pertroleum Company, Salt Lake City, Utah

[21] Appl. No.: 262,192

[22] Filed: May 11, 1981

[51] Int. Cl.[3] ..... E21B 43/247; E21B 43/40; E21C 41/10

[52] U.S. Cl. ..... 166/259; 166/261; 166/266; 166/271; 166/272; 208/11 R; 299/2

[58] Field of Search ..... 166/247, 256, 259, 261, 166/266, 267, 271, 272, 50; 208/11 R; 299/2

[56] References Cited

U.S. PATENT DOCUMENTS

| | | | |
|---|---|---|---|
| 2,970,826 | 2/1961 | Woodruff | 166/256 X |
| 2,974,937 | 3/1961 | Kiel | 166/272 X |
| 3,017,168 | 1/1962 | Carr | 166/256 X |
| 3,362,751 | 1/1968 | Tinlin | 299/2 |
| 3,437,378 | 4/1969 | Smith | 299/2 |
| 3,464,913 | 9/1969 | Berry | 208/11 R |
| 3,480,082 | 11/1969 | Gilliland | 166/303 X |
| 3,513,914 | 5/1970 | Vogel | 166/259 X |
| 3,516,495 | 6/1970 | Patton | 166/272 |
| 3,521,709 | 7/1970 | Needham | 166/247 |
| 3,619,405 | 11/1971 | Smith | 208/11 R |
| 3,736,247 | 5/1973 | Jones, Jr. et al. | 208/11 R |
| 3,766,982 | 10/1973 | Justheim | 166/247 X |
| 4,158,467 | 6/1979 | Larson et al. | 166/267 X |
| 4,218,304 | 8/1980 | Styring, Jr. | 208/11 R |

*Primary Examiner*—Stephen J. Novosad
*Assistant Examiner*—George A. Suchfield
*Attorney, Agent, or Firm*—Mallinckrodt & Mallinckrodt

[57] ABSTRACT

Oil shale is retorted, preferably in situ, by passing velocity flow of super-heated air through one or more conduit-like passages in direct contact with exposed surfaces of oil shale. Kerogen pyrolysis products are recovered by condensation of the vapors and collection of the condensate and by collection of the gases and separation of the valuable gases from the normally waste gases. Some of the waste gases may be recycled with the air for controlling combustion of the kerogen content of the shale.

6 Claims, 1 Drawing Figure

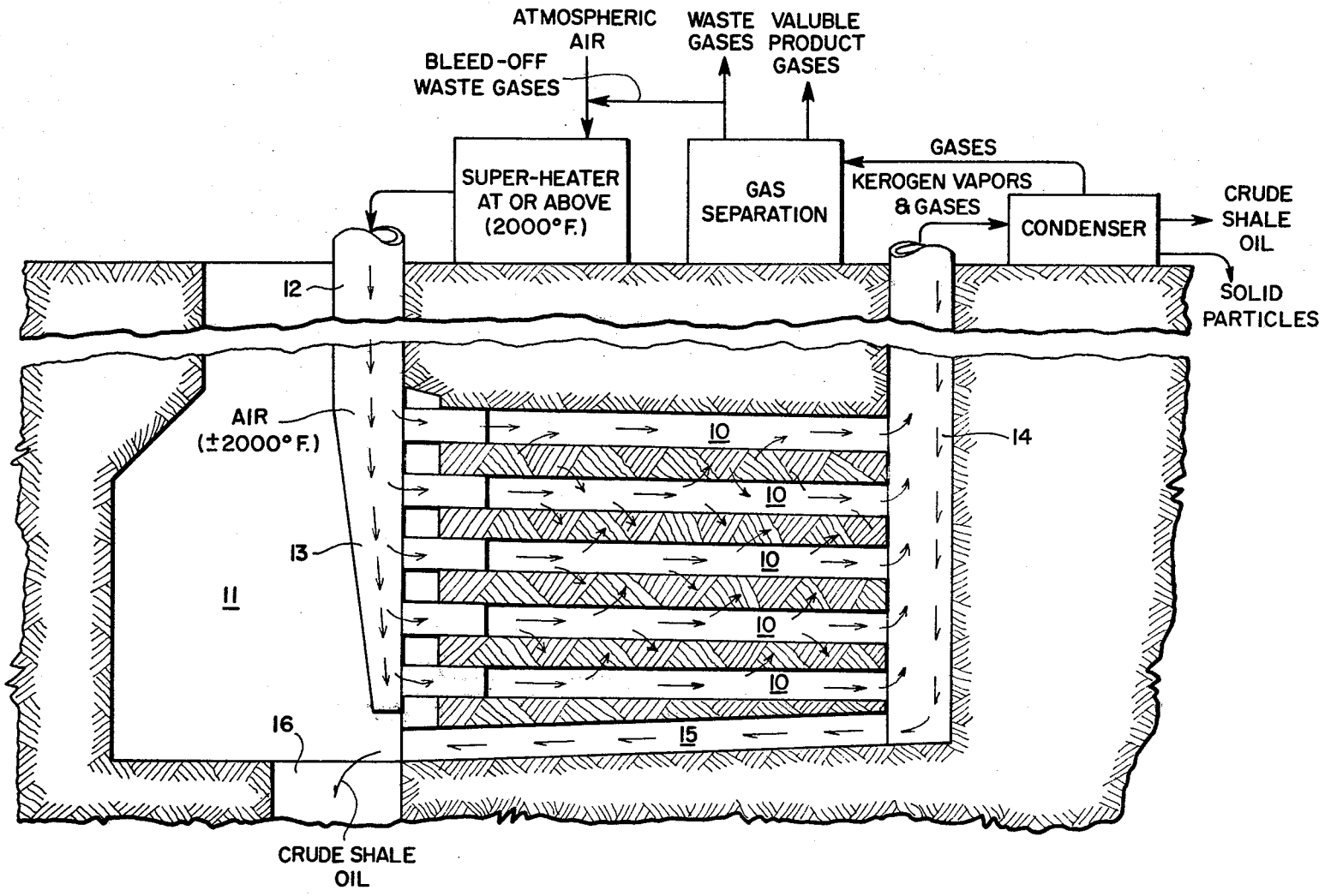
CRUDE SHALE OIL
SOLID PARTICLES
CONDENSER
GASES
KEROGEN VAPORS & GASES
GAS SEPARATION
VALUBLE PRODUCT GASES
WASTE GASES
ATMOSPHERIC AIR
BLEED-OFF WASTE GASES
SUPER-HEATER AT OR ABOVE (2000° F.)
14
10
15
12
13
16
11
AIR (±2000° F.)
CRUDE SHALE OIL

METHOD OF RETORTING OIL SHALE BY VELOCITY FLOW OF SUPER-HEATED AIR

BACKGROUND OF THE INVENTION

1. Field

The invention has to do with the treatment of oil shale, either in situ or at the surface, with a hot gas for the recovery of valuable constituents from the kerogen content thereof.

2. State of the Art

In my application Ser. No. 785,552 filed Jan. 5, 1959, which was abandoned after an unsuccessful appeal to the Court of Appeals of the District of Columbia from a decision of the District Court for the District of Columbia in the case of Clarence I. Justheim v. David L. Ladd, Commissioner of Patents, 147 U.S.P.Q. 306, it was shown by testimony of Dr. John F. Schairer of the Carnegie Institution, Washington, D.C., that oil shale subjected to 2000° F. in a crucible will fissure extensively and become susceptible to the passage of heat and evolved gases, and other distillation products therethrough. Since Llungstrom U.S. Pat. No. 2,732,195 of Jan. 24, 1956 discloses the use of an electric heater, dropped down a bore hole in an underground oil shale formation to impose a temperature of up to 1000° C. (1836° F.) on the surrounding oil shale, and since tests by Dr. Schairer at 1832° F. showed some fissuring, the court in effect decided that the use of 2000° F. was a mere unpatentable extension of the teaching of the Swedish patent.

Even though the testimony of Dr. Schairer was to the effect that the extent of fissuring at the 2000° F. temperature, was indeed surprising, no one since that time to applicant's knowledge has proposed the use of such a high temperature in the treatment of oil shale, except applicant by his own U.S. Patents, No. 3,598,182 of Aug. 10, 1971, and No. 3,766,982 of Oct. 23, 1973, and Guido O. Grady in his U.S. Pat. No. 3,692,110 of Sept. 19, 1972, which is assigned to Cities Service Oil Company.

Applicant's latter patent, U.S. Pat. No. 3,766,982, teaches the use of an inexpensive hot gaseous fluid, such as air or flue gas, as a super-hot, heat transfer agent to volatilize kerogen and to crack and fissure the oil shale to make it permeable to gas flow therethrough. In accordance with the teaching, the gas (e.g. air) is heated either above or below ground by means of a nuclear reactor, pebble heater, or other suitable device to the 2000° F. temperature and is injected into an underground oil shale formation by means of one or more bore holes extending downwardly from the surface. One or more recovery bore holes are driven into the formation apart from the gas injection bore holes, and a heat front, provided by this super-hot injected gas, migrates from the injection bore holes toward the recovery bore holes through the intervening oil shale, rendering such intervening oil shale pervious to the flow of both the injected gas and of volatilized kerogen resulting from the applied heat. The patent is particularly concerned with at least partial hydrogenation of the kerogen vapors before they are brought to the surface through the recovery bore holes and teaches the injection of hydrogen gas into the path of flow of the vaporized kerogen in the vicinity of such recovery bore holes, whereby at least partially hydrogenated hydrocarbonaceous vapors are withdrawn through said recovery bore holes.

The Grady patent merely mentions a hot zone temperature between about 700° F. and about 2,500° F. in retorting a rubble of broken oil shale in situ in the chimeny created by a nuclear explosive, which chimney is shown packed full of such rubble. Retorting is accomplished by the injection of a "retorting fluid" (a combustion or combustive gas or steam) into the rubble and causing it to filter through the rubble to a production well.

SUMMARY OF THE INVENTION

In accordance with the present invention, retorting is accomplished by a velocity stream of super-hot air traveling through one or more conduit-like passages, in direct contact with oil shale surfaces for the purpose of pyrolyzing the kerogen content of the oil shale and ultimately delaminating it so as to render it permeable to fluid flow therethrough. The down-stream flow from such passage or passages is passed through vapor condensing means, wherein kerogen vapors are condensed to liquid from and any solid particles are trapped, and the remaining gases are subjected to known separation procedures for recovery of those which represent valuable products of the operation from those which may be disposed of as waste gases or which may be utilized in the operation by admixture with the air as a combustion control factor or otherwise utilized for their heat content. The liquid condensate represents a crude oil product from which any solid particles should be separated by known procedures. The valuable gases become direct end products of the retorting operation.

The process of the invention has been carried out on a test basis by the Battelle Columbus Laboratories of the Battelle Memorial Institute, Columbus, Ohio, utilizing solid specimens of untreated Laramie oil shale as mined from an underground deposit of same. The results show that the process may be carried out either in situ, within an underground area prepared for retorting in accordance with the invention, or at the surface in suitable retorting facilities. The important thing is to provide for directly contacting exposed oil shale surfaces with a velocity stream of super-hot air flowing through a conduit-like passage at a temperature of approximately 2000° F. for a time period sufficient to ultimately raise the temperature of the oil shale to be retorted to approximately 2000° F., whereby progressive delamination and deep fissuring of the oil shale from the contacted surfaces thereof are achieved after kerogen pyrolysis.

Partial combustion of the kerogen or products evolved therefrom during pyrolysis is relied upon to help maintain the super-hot temperature, and the invention contemplates as an optional feature thereof the exercising of control over the extent of combustion by introducing into the stream of air being heated for introduction to the shale of some of the fixed product gases which would normally be sent to waste. The proportion of such fixed product gases in the air stream will depend upon circumstances, and will be monitored to yield the highest effective recovery of the valuable end products of the operation.

THE DRAWING

The best mode presently contemplated of carrying out the invention in actual practice is illustrated in the accompanying drawing in which the single figure is a schematic representation in longitudinal vertical section of an in situ retort and of surface facilities in accordance with the invention.

DETAILED DESCRIPTION OF THE ILLUSTRATED EMBODIMENT

It is preferred to carry out the retorting of the oil shale in situ to avoid the expense of mining and disposing of the spent shale following retorting.

Although various forms of retorts can be fashioned in the oil shale itself to provide conduit-like passages for the flow of super-hot air as velocity streams in direct contact with oil shale surfaces and for the discharge of such streams into a recovery passage or passages, one form presently contemplated as the best is substantially vertical series of conduit-like passages 10 formed more or less horizontally in a blocked-out portion of the oil shale formation by boring into the formation at spaced, side-by-side locations along a wall 11*a* of a room 11 that has been provided in the shale formation by the application of well known mining techniques. The excavated oil shale and that obtained from boring or drilling to provide the passages may be retorted at the surface in a retort fabricated to similarly expose the shale to velocity streams of super-hot air flowing through conduit-like passages provided by longitudinally or otherwise slit tubes about which the shale is packed, or such a retort may be constructed and operated in the room 11 concurrently with or following retorting of the in situ shale.

Super-hot air at approximately 2000° F. is supplied from suitable heating means, such as a conventional pebble heater which may be located at the surface as indicated, to a suitably heat insulated conduit 12 and header 13 arranged to deliver such super-hot air to the individual passages 10 in turn, substantially without temperature diminution. Alternately, depending upon practicality under the circumstances, the super-hot air could be heated to a temperature significantly above 2000° F. and delivered to the passages 10 at the desired temperature of approximately 2000° F.

Following flow through passages 10 as respective streams of super-hot air, and ultimately from passage to passage through fissuring resulting from shale delamination, the flowing air and kerogen pyrolysis products carried thereby will discharge into one or more recovery bore holes or out flow headers 14, which are preferably drilled from the surface as risers to interconnect the passages 10 at their downstream outflow ends and to enable the vapor and gaseous flows therefrom to pass into a condenser, indicated as such, at the surface. The passages 10 preferably slope downwardly slightly toward bore hole or holes 14, so that any liquid condensate that may initially form toward the downstream ends of such passages will flow into the bore hole or holes and will, together with any liquid condensate that may form within such bore hole or holes, flow along a lowermost passage 15 into a sump 16 for pumping or otherwise bringing to the surface as a crude shale oil product.

Uncondensed gases emerging from bore hole or holes 14 will normally be made up of valuable product gases, such as carbon dioxide, hydrogen, methane, acetylene, and various higher hydrocarbon fractions such as propylene, propane, etc., and of waste combustion gases, e.g. carbon monoxide. Such uncondensed gases are collected and passed through a suitable separation stage, indicated as such, in which those that are valuable are recovered and those not worth recovering are either passed to waste or recycled into the super-heater with the inflow of air thereto to conserve heat and to moderate and control combustion of the kerogen in the oil shale being retorted.

The condensate from the condenser and any condensate collected from sump 16 constitues a crude shale oil product which may carry some solid shale degradation particles. These may be eliminated by settling or filtration of the liquid product prior to recovery thereof as an end product of the process.

A series of laboratory tests run by Batelle Columbus Laboratories of the Batelle Memorial Institute, Columbus, Ohio, are indicative of results obtainable by the method of this invention.

Respective samples of Laramie Oil Shale were used in the tests. In each test, an oil shale sample in the form of a small solid block was placed in an elongate, silica, pyrolysis tube within a furnace, and a velocity stream of super-heated air (2000° F.) was passed through the length of such tube, so as to flow over and around such sample in direct contact with its superficial surfaces and discharge into a condensor receiver. Uncondensed gases were run into one or the other of two gas receivers. A flowmeter and a wet-test meter were used to measure the rate and volume of input airflow, and a dry meter was used to measure volume of effluent gases. The meters were calibrated against one another by monitoring the flow of air through the system for prolonged periods, and a final calibration was made using meter readings at the end of each run when gas evolution from the shale sample was expected to have ceased.

In making a run, the furnace was preheated to 2000° F. with the shale sample outside the furnace. The pyrolysis was started by initiating the air flow, then immediately moving the shale sample into the 2000° F. air-flow zone, the location of which had been determined previously. The temperature was checked to be 2000±15 F by use of a thermocouple placed in the reaction tube next to the shale sample. Initially, temperature in the region determined by the thermocouple dropped 30°–40° F. due to insertion of the cool shale sample. Recovery to the nominal temperature required approximately 10 minutes. It was during this initial heatup of the shale sample that the major portion of the kerogen material was evolved.

The condenser-receiver was a pyrex flask packed with pyrex wool and submerged in a water bath at room temperature (64 to 68 F). The major portion of the liquids and solids evolved from the shale was captured in the receiver. However, capture was not complete, since a small portion remained in the transfer tube ahead of the receiver.

The gas receivers were Teflon-film bags which were initially evacuated and collapsed and were attached to the system by use of a valve arrangement that permitted sending the effluent into either, as desired, and transferring a portion of the gas, after it was blended by kneading the bag, into a pyrex sample flask for later analysis by mass spectrography. Separate samples were taken for the periods, 0 to ½ hour, ½ to 1 hour, and 1 to 2 hours of run time.

Weight checks made on the oil shale samples and on the condenser-receiver before and after each run provided indications of the proportion of material removed from the shale samples by the pyrolysis treatments. The data indicated that, on average, about 21 percent of the initial mass of the oil shale was evolved and, of this total, 12 to 33 percent was retained in the room-temperature condenser, with a major portion of the remainder (approaching 67 to 88 percent of the total) presumably evolved as gas. Variations were probably due to variations of shale-sample composition and/or processing conditions.

Analytical and gas-evolution data for pyrolysis runs were obtained for the time periods, 0½, ½1, and 1–2 hours of run time. Since most of the gaseous material was evolved in the initial period, weighted overall composition of the gases evolved in the periods 0–1 hour and 0–2 hours did not differ greatly from that given for the 0½ hour sample in each case.

The data show that principal products are carbon dioxide, carbon monoxide, hydrogen, methane, and ethylene.

The following table shows weight loss of the oil shale samples subjected to test:

| | RUN NUMBER | | | | |
|---|---|---|---|---|---|
| | 1 | 2 | 3 | 4 | 5 |
| Initial Sample Weight (Grams) | 39.772 | 38.011 | 39.478 | 38.502 | 36.483 |
| Total Weight Loss | | | | | |
| Grams | 8.592 | 8.171 | 8.275 | 9.765 | 7.513 |
| Percent | 21.6 | 21.5 | 21.0 | 25.4 | 20.6 |
| Weight of Solids and Liquids in Condenser (grams) | — | 1.7 | 1.4 | 1.2 | 2.5 |

The following tables show pyrolysis data for runs numbers 3, 4 and 5 (no data was obtained for runs numbers 1 and 2):

| RUN 3 | | | |
|---|---|---|---|
| Temperature, F. | | 2000 | |
| Air flow rate, ml/min | | 218 | |
| Approximate volume of gas evolved from shale sample, liters, | | | |
| In ½ hour | | 5.4 | |
| In 1 hour | | 5.4 | |
| In 2 hours | | 5.8 | |
| Results of Mass Spectrographic Analysis, of Gaseous Effluent, volume percent | | | |
| Sampling Period, hr | 0–½ | ½–1 | 1–2 |
| Substance: | | | |
| Hydrogen, $H_2$ | — | — | — |
| Carbon dioxide, $CO_2$ | — | 11.2 | 3.02 |
| Carbon monoxide, CO | — | 5.80 | 1.42 |
| Methane, $CH_4$ | — | 1.00 | 0.32 |
| Acetylene and ethylene $C_2H_2$, $C_2H_4$ | — | 0.61 | 0.30 |
| Ethane, $C_2H_6$ | — | 0.03 | 0.01 |
| Propylene, $C_3H_6$ | — | 0.05 | 0.01 |
| Propane, $C_3H_8$ | — | 0.001 | 0.001 |
| Butylene, $C_4H_8$ | — | 0.01 | 0.001 |
| iso-butane, $C_4H_{10}$ | — | 0.001 | 0.001 |
| n-butane, $C_4H_{10}$ | — | 0.001 | 0.001 |

| RUN 4 | | | |
|---|---|---|---|
| Temperature, F. | | 2000 | |
| Air flow rate, ml/min | | 617 | |
| Appropriate volume of gas evolved from shale sample, liters | | | |
| In ½ hour | | 2.2 | |
| In 1 hour | | 2.5 | |
| In 2 hours | | 2.7 | |
| Results of Mass Spectrographic Analysis, of Gaseous Effluent, volume percent | | | |
| Sampling Period, hr | 0–½ | ½–1 | 1–2 |
| Substance: | | | |
| Hydrogen, $H_2$ | 2.10 | — | — |
| Carbon dioxide, $CO_2$ | 14.8 | 2.12 | 0.39 |
| Carbon monoxide, CO | 3.40 | 0.58 | 0.01 |
| Methane, $CH_4$ | 1.14 | 0.10 | 0.008 |
| Acetylene and ethylene $C_2H_2$, $C_2H_4$ | 0.89 | 0.08 | 0.009 |
| Ethane, $C_2H_6$ | 0.02 | 0.004 | 0.004 |
| Propylene, $C_3H_6$ | 0.005 | 0.004 | 0.001 |
| Propane, $C_3H_8$ | 0.008 | 0.001 | 0.001 |
| Butylene, $C_4H_8$ | 0.001 | 0.001 | 0.001 |
| iso-butane, $C_4H_{10}$ | 0.001 | 0.001 | 0.001 |
| n-butane, $C_4H_{10}$ | 0.001 | 0.001 | 0.001 |

| RUN 5 | | | |
|---|---|---|---|
| Temperature, F. | | 2000 | |
| Air flow rate, ml/min | | 205 | |
| Approximate volume of gas evolved from shale sample, liters, | | | |
| In ½ hour | | 7.4 | |
| In 1 hour | | 7.6 | |
| In 2 hours | | 8.9 | |
| Results of Mass Spectrographic Analysis, of Gaseous Effluent, volume percent | | | |
| Sampling Period, hr | 0–½ | ½–1 | 1–2 |
| Substance: | | | |
| Hydrogen, $H_2$ | 5.13 | — | — |
| Carbon dioxide, $CO_2$ | 9.51 | 13.5 | 3.99 |
| Carbon monoxide, CO | 5.50 | 7.22 | 1.91 |
| Methane, $CH_4$ | 3.34 | 1.49 | 0.39 |
| Acetylene and ethylene $C_2H_2$, $C_2H_4$ | 1.4 | 0.59 | 0.14 |
| Ethane, $C_2H_6$ | 0.2 | 0.1 | 0.04 |
| Propylene, $C_3H_6$ | — | — | — |
| Propane, $C_3H_8$ | — | — | — |
| Butylene, $C_4H_8$ | — | — | — |
| iso-butane, $C_4H_{10}$ | — | — | — |
| n-butane, $C_4H_{10}$ | — | — | — |

In the above test runs and data obtained therefrom, virtually all the gas was evolved in the initial ten minute heatup period. In the data given under the designation "Acetylene and ethylene", about 80% was ethylene. Analyses for hydrogen were run only on the 0½ hour samples in view of the fact that such samples contained most of the evolved gases.

It should be noted that the volume of gases obtained in Run 4 was not representative, because some gases were lost when water was blown out of the manometer by rapid evolution of gas. Again, it should be noted that no data was obtained for the 0½ hour samples in Run 3 due to loss of samples by reason of strain-fracture of the pyrex sample flask.

Whereas the method is here described with respect to a specific procedure presently regarded as the best mode of carrying out the invention, it is to be understood that various changes may be made and other procedures adopted without departing from the broader inventive concepts disclosed herein and comprehended by the claims that follow.

I claim:

1. A process for retorting oil shale and recovering pyrolysis products therefrom, comprising forming a series of vertically spaced, conduit-like, bore passages and an insulated, substantially vertical, inflow header in successive communication with corresponding ends of said passages in a mass of oil shale for the supply of and for the flow of super-hot air as velocity streams against, along, and past said oil shale in direct contact with exposed surfaces of said oil shale, and forming a second, substantially vertical, outflow header in successive communication with the corresponding opposite ends of said passages; flowing streams of unconfined, superhot air through said passages from a source in common by way of said inflow header, said streams having volume and velocity sufficient to entrain and carry oil shale pyrolysis products through said passages to a common location of recovery, the temperature of said air being sufficiently high to delaminate and deeply fissure the oil shale contacted by said streams between said passages and to establish intercommunication between said passages for fluid flow therebetween in contact with said oil shale; continuing the flow of said streams and entrained pyrolysis products from said passages by way of said outflow header to condensing means for vapor components of said pyrolysis products; separating from the resulting liquid condensate any solid particles entrained by said streams and entrapped by said condensate; flowing gaseous components of said streams from said condensing means to gas collecting means; separating valuable and normally waste gases from said gaseous components of the streams; and recovering both the liquid condensate, substantially free of solid particles, and said valuable gas an end products of the process.

2. A process according to claim 1, wherein the passages are bore holes driven through a block of the oil shale in situ.

3. A process according to claims 1 or 2, wherein the temperature of the air introduced into the passages is approximately 2000° F.

4. A process according to claim 2, wherein condensing means is located at the surface and communicates with the downstream ends of the passages by way of the outflow header.

5. A process according to claim 4, wherein a sump is provided in the in situ workings for receiving any liquid flowing into or formed in the outflow header; and the liquid in said sump is brought to the surface as a crude shale oil product.

6. A process according to claim 1, wherein some of the normally waste gas is recycled with the air to control the extent of combustion of the kerogen content of the oil shale.

* * * * *

UNITED STATES PATENT OFFICE

CERTIFICATE OF CORRECTION

PATENT NO. : 4,384,614

DATED : May 24, 1983

INVENTOR(S) : Clarence I. Justheim

It is certified that error appears in the above-identified patent and that said Letters Patent are hereby corrected as shown below:

Column 2, line 23, change "from" to —form—;
Column 5, line 7, change "01/2, 1/21" to —0-1/2, 1/2-1—; and line 12, change "01/2" to —0-1/2—;
Column 6, line 47, change "01/2" to —0-1/2—;
Column 8, line 2, change "an" to —as—.

Signed and Sealed this

*Twenty-sixth* Day of *July 1983*.

[SEAL]

*Attest:*

GERALD J. MOSSINGHOFF

*Attesting Officer*

*Commissioner of Patents and Trademarks*